United States Patent [19]

Kudoh

[11] Patent Number: 4,885,613

[45] Date of Patent: Dec. 5, 1989

[54] DEVICE APPLICABLE TO AN IMAGE RECORDING APPARATUS FOR FEEDING A RECORDING MEDIUM

[75] Inventor: Kunio Kudoh, Yokohama, Japan

[73] Assignee: Ricoh Company, Ltd., Tokyo, Japan

[21] Appl. No.: 254,804

[22] Filed: Oct. 7, 1988

[30] Foreign Application Priority Data

Oct. 8, 1987 [JP] Japan ..... 62-254480

[51] Int. Cl.[4] ..... G03G 15/00

[52] U.S. Cl. ..... 355/310; 355/311; 271/9

[58] Field of Search ..... 355/310, 311, 309; 271/9, 258, 259, 263, 265; 226/10, 24

[56] References Cited

U.S. PATENT DOCUMENTS

| | | | |
|---|---|---|---|
| 3,418,047 | 12/1968 | Lee et al. | 355/310 X |
| 3,645,157 | 2/1972 | Giulio et al. | 355/310 X |
| 3,951,023 | 4/1976 | Kaikhushiroo | 355/310 X |
| 4,706,099 | 11/1987 | Suzuki | 355/311 X |

*Primary Examiner*—R. L. Moses

*Attorney, Agent, or Firm*—Oblon, Spivak, McClelland, Maier & Neustadt

[57] ABSTRACT

A device applicable to an image recording apparatus for feeding a recording medium in the form of a paper roll or a cut paper to a predetermined recording section of the apparatus. The device includes a plurality of paper feed mechanisms for feeding a recording medium. A sensor responsive to the kind of a recording medium in the form of a roll and a sensor responsive to the amount of remaining recording medium are associated with each of the paper feed mechanisms. When two or more paper feed mechanisms are each loaded with a recording medium of a desired kind, one of them which has a larger amount of recording medium remaining therein is automatically selected. When the amount of recording medium remaining in the feed mechanism being selected becomes substantially zero, another feed mechanism which is also loaded with a recording medium of the specified kind is automatically selected in place of the feed mechanism which has been exhausted. In the case of a rolled recording medium, when the length of recording medium remaining in the feed mechanism being selected and substantially run out is short of a necessary length, an extra recording medium is fed in addition to the number of recording media which is specified beforehand so as to produce an extra copy.

4 Claims, 21 Drawing Sheets

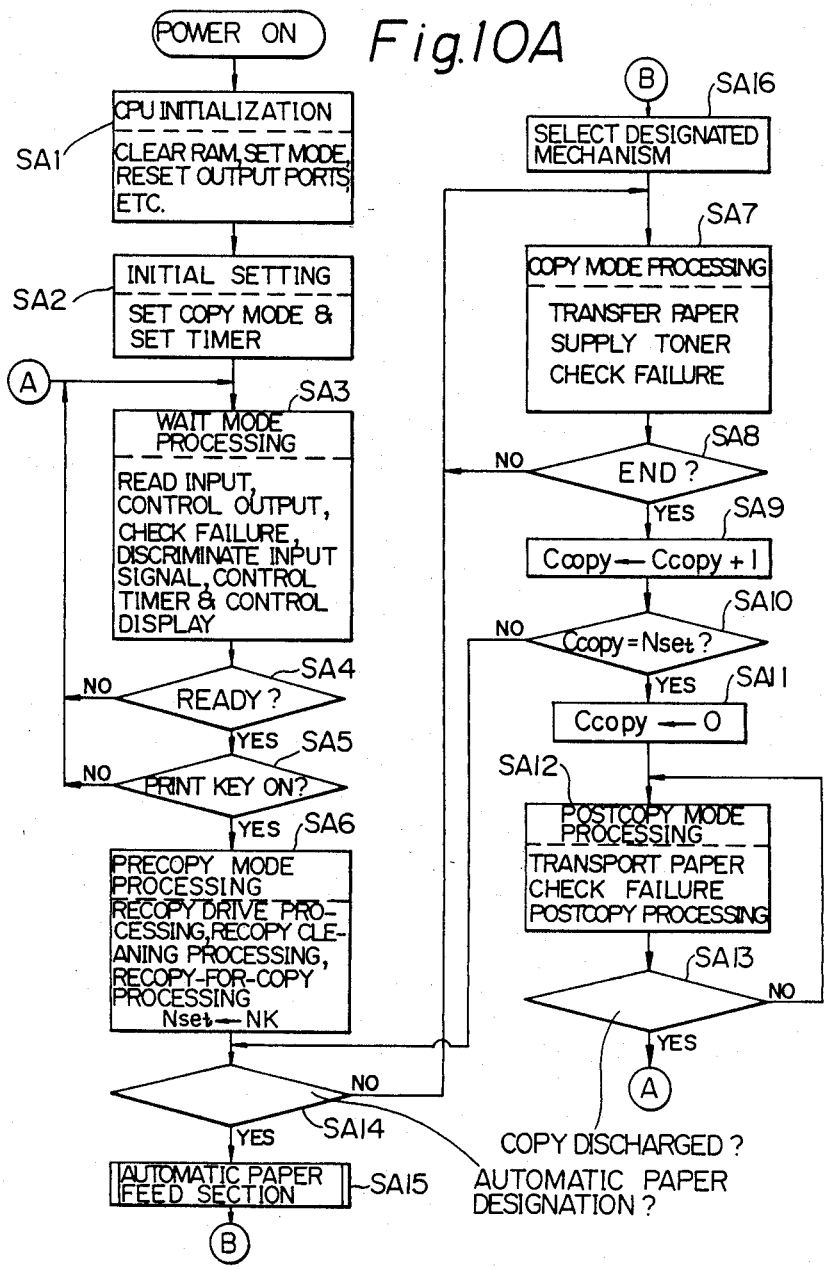
Fig.10A
POWER ON
CPU INITIALIZATION
CLEAR RAM, SET MODE, RESET OUTPUT PORTS, ETC.
SA1
INITIAL SETTING
SET COPY MODE & SET TIMER
SA2
A
WAIT MODE PROCESSING
READ INPUT, CONTROL OUTPUT, CHECK FAILURE, DISCRIMINATE INPUT SIGNAL, CONTROL TIMER & CONTROL DISPLAY
SA3
READY ?
SA4
NO
YES
PRINT KEY ON?
SA5
NO
YES
PRECOPY MODE PROCESSING
RECOPY DRIVE PROCESSING, RECOPY CLEANING PROCESSING, RECOPY-FOR-COPY PROCESSING
Nset ← NK
SA6
NO
YES
SA14
AUTOMATIC PAPER FEED SECTION
SA15
B
B
SA16
SELECT DESIGNATED MECHANISM
SA7
COPY MODE PROCESSING
TRANSFER PAPER
SUPPLY TONER
CHECK FAILURE
END ?
SA8
NO
YES
SA9
Ccopy ← Ccopy + 1
Ccopy = Nset ?
SA10
NO
YES
SA11
Ccopy ← 0
SA12
POSTCOPY MODE PROCESSING
TRANSPORT PAPER
CHECK FAILURE
POSTCOPY PROCESSING
SA13
NO
YES
A
COPY DISCHARGED ?
AUTOMATIC PAPER DESIGNATION ?

| Fig. 10B-1 | Fig. 10B-2 |
|---|---|

DEVICE APPLICABLE TO AN IMAGE RECORDING APPARATUS FOR FEEDING A RECORDING MEDIUM

BACKGROUND OF THE INVENTION

The present invention relates to a device applicable to an image recording apparatus for feeding a recording medium in the form of a roll of paper or a cut paper sheet to a predetermined recording section of the apparatus and, more particularly, to a recording medium feeding device of the type having a plurality of paper feed mechanisms which are selectively usable.

A device for feeding a recording medium which includes a plurality of paper feed mechanisms and uses the combination of a roll of paper and a cutter assembly is disclosed in Japanese Laid-Open Utility Model Publication (Kokai) No. 54-84482 and Japanese Laid-Open Patent Publication Nos. 58-113052 and 59-229370 by way of example. In order that a facsimile apparatus or similar image recoording apparatus may perform a continuous recording operation, a paper serving as a recording medium has to be continuously supplied to a recording section of the apparatus. In the case that the paper is in the form of a cut paper sheet, a number of such sheets may be stacked on a tray or a cassette and sequentially fed one by one for the continuous recording operation. In the case of a rolled paper, it may be sequentially paid out and cut at a predetermined length to in effect implement the continuous paper feed. The recording operation is of course interrupted when the recording medium in the paper feed mechanism in use runs out. To effect continuous recording without any interruption, therefore, it is necessary that a sufficient amount of recording medium be left in the paper feed mechanism to be used. When the apparatus is equipped with a plurality of paper feed mechanisms and each of such mechanisms is loaded with an expected paper, the possibility of interruption of operation will be reduced if the operator selects one of those mechanisms which accommodates the largest amount of paper beforehand. However, checking the paper feed mechanisms one by one to see the amounts of paper remaining therein and then selecting one of them which has the largest amount of paper is as awkward as the manipulation which would be performed in the event of the interruption of recording operation.

SUMMARY OF THE INVENTION

It is therefore an object of the present invention to provide a recording medium feeding device for an image recording apparatus which eliminates the interruption of continuous recording operation due to the exhaustion of a recording medium and thereby frees the operator from troublesome work.

It is another object of the present invention to provide a generally improved device applicable to an image recording apparatus for feeding a recording medium.

A device installed in an image recording apparatus for feeding a recording medium of the present invention comprises a plurality of recording medium feeding means each comprising kind sensing means responsive to a kind of a recording medium, remaining amount sensing means responsive to a remaining amount of the recording medium, pulling means for pulling a leading edge of the recording medium onto a predetermined transport path, and driving means for driving the pulling means, and control means for controlling the recording medium feeding means such that any of the recording medium feeding means which is loaded with a recording medium of a kind specified beforehand is identified on the basis of outputs of the kind sensing means and, when a plurality of the recording medium feeding means are each loaded with the recording medium of the specified kind, one of the recording medium feeding means which has the largest amount of recording medium remaining therein is selected as recording medium feeding means for feeding a recording medium on the basis of outputs of the remaining amount sensing means which are individually associated with the plurality of recording medium feeding means.

BRIEF DESCRIPTION OF THE DRAWINGS

The above and other objects, features and advantages of the present invention will become more apparent from the following detailed description taken with the accompanying drawings in which:

FIGS. 10A, 10B, and 10C are flowcharts demonstrating the outline of operation of a main control unit shown in FIG. 4a.

DESCRIPTION OF THE PREFERRED EMBODIMENT

Figure 1:
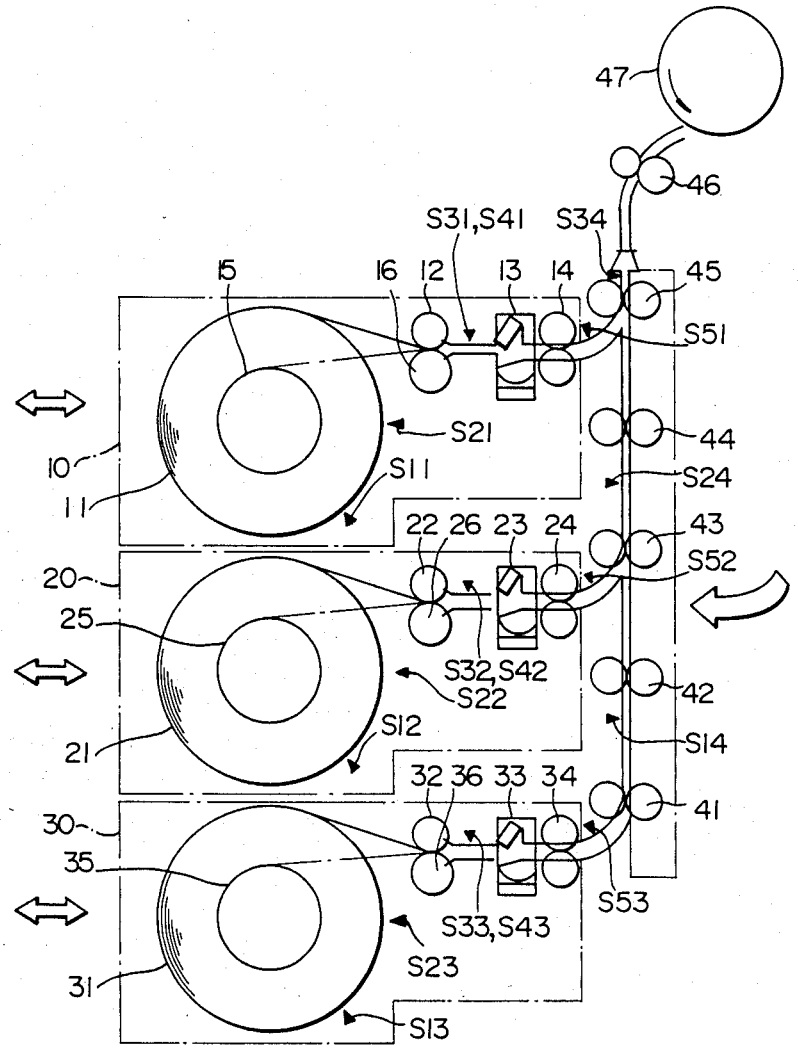
FIG. 1 is a front view showing paper feed mechanisms and their associated elements of a copier to which the present invention is applied.

Referring to FIG. 1 of the drawings, a paper feeding section of a copier to which the present invention is applied is shown. In the figure, the copier includes three paper feed mechanisms 10, 20 and 30 which are disposed one above another. The paper feed mechanism 10 is provided with a rotatable shaft 15 on which a roll of paper roll 11 is mounted, a feed roller 16 for paying out the paper from the roll 11, a pinch roller 12 facing the feed roller 16, a cutter assembly 13 for cutting the paper paid out from the roll 11, a pull-out roller 14, etc. The shaft, 15, a rotatable shaft on which the feed roller 16 is mounted and a rotatable shaft included in the cutter assembly 13 are respectively operatively connected to an electromagnetic brake BRK, an electric motor M1 and an electric motor M2 which will be described. Operatively connected to an electric motor, not shown, the pull-out roller 14 is driven in synchronism with the recording operation of the copier. Likewise, the sheet feed mechanisms 20 and 30 are respectively provided with paper rolls 21 and 31, feed rollers 26 and 36, pinch rollers 22 and 32, cutter assemblies 23 and 33, pull-out rollers 24 and 34, etc. In this particular example, each of the feed rollers 16, 26 and 36 is driven by a different electric motor, and so is each of the cutter assemblies 13, 23 and 33. A vertical transport mechanism includes a number of transport rollers 41 to 45 and is located downstream of the pull-out rollers 14, 24 and 34. Located downstream of the vertical transport mechanism is a register roller 46. The reference numeral 47 designates a photoconductive drum adapted for the recording operation.

Figure 2A:
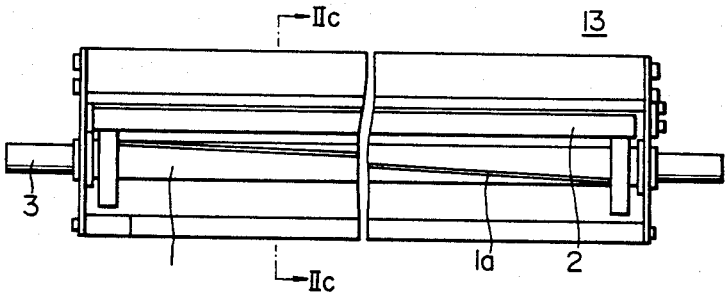
FIG. 2A is a side elevation of a cutter assembly as viewed from the left of FIG. 1.
Figure 2B:
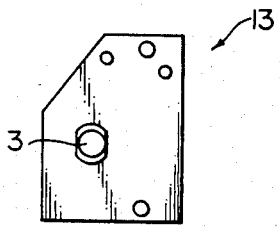
FIG. 2B is a side elevation of the cutter assembly as viewed from the left of FIG. 2A.
Figure 2C:
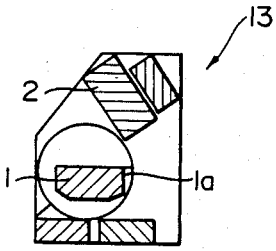
FIG. 2C is a section along line II*c*-II*c* of FIG. 2A.

FIGS. 2A, 2B and 2C show the cutter assembly 13 of FIG. 1 in detail. Implemented as a rotary cutter, the cutter assembly 13 includes a rotary blade 1 and a stationary blade 2. The rotary blade 1 has an edge 1*a* which extends obliquely (or spirally) relative to the axis of rotation of the blade 1. Hence, the meshing point of the rotary blade 1 and stationary blade 2, i.e., cutting point sequentially shifts from one end to the other end of the axis of rotation as the blade 1 is rotated. The paper is fully cut before the rotary blade 1 completes one rotation. A shaft 3 connected to the rotary blade 1 is operatively connected to the output shaft of the electric motor M2. The other cutters 23 and 33 are constructed in the same manner as the cutter assembly 13.

Figure 2D:
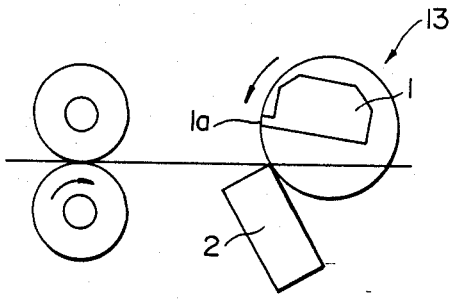
FIGS. 2D, 2E and 2F schematically show the operation of an ordinary rotary cutter.
Figure 2E:
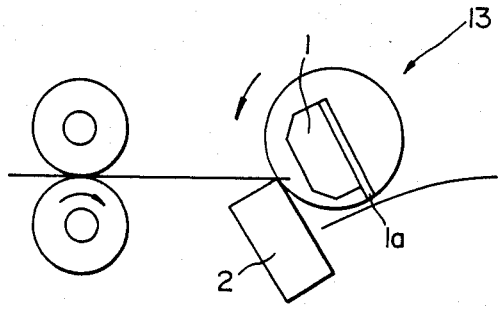
Figure 2F:
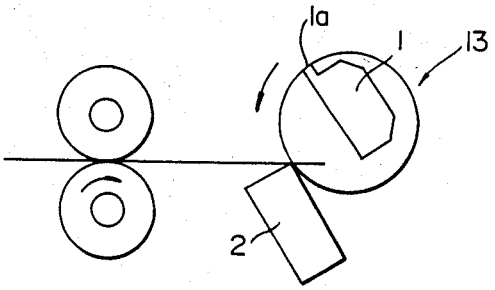

FIGS. 2D, 2E and 2F demonstrate an exemplary operation of a rotary cutter for cutting a webbing of paper. It is to be noted that the positional relationship between the rotary blade 1 and the stationary blade 2 is opposite to the relationship shown in FIG. 2C.

Figure 8A:
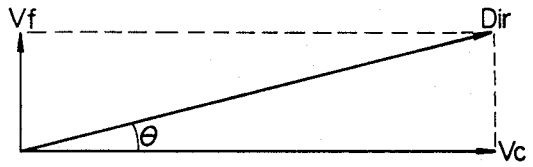
FIG. 8A is a vector diagram showing a relationship between the movement of paper paid out from a roll and the movement of a cutting point.
Figure 8B:
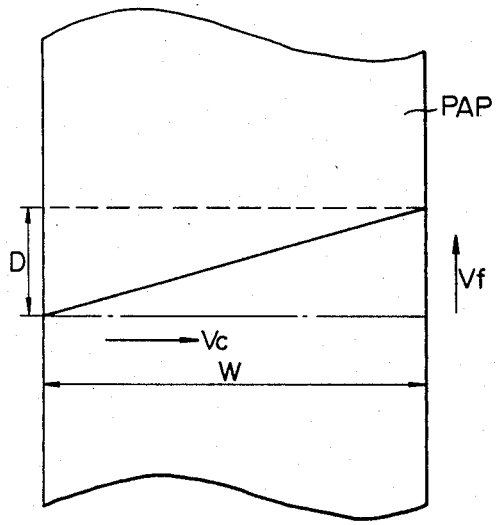
FIG. 8B is a plan view showing a cutting position where the paper is to be cut.

When the cutter assembly 13 is operated to cut the paper 11 being paid out, the cutting line extends obliquely relative to the axis of rotation of the cutter assembly 13, as shown in FIG. 8B. This is because the paper 11 is advanced in the intended direction of paper feed while the cutting point sequentially shifts from one end to the other end of the paper 11. However, interrupting the feed of the paper 11 for cutting it would prolong the period of time necessary for cutting the paper 11. The inclination of the cutting line mentioned above is dependent upon the shifting rate of the cutting point and the feeding rate of the paper 11. In the illustrative embodiment, therefore, a control is so executed as to maintain this inclination constant and the cutter assemblies 13, 23 and 33 are each fixed in a position which is inclined complementary to and in the opposite direction to the inclination of the cutting line. This arrangement allows the actual cutting line of the paper 11 to extend in a direction perpendicular to the direction of paper feed, thereby eliminating oblique cutting.

Referring again to FIG. 1, the paper feed mechanism 10 further includes two sensor units S31 and S41 interposed between the feed roller 16 and the cutter assembly 13, two sensor units S11 and S21 located to face the periphery of the roll 11, and a sensor unit S51 located downstream of the pull-out roller 14. The other paper feed mechanisms 20 and 30 are each provided with similar sensor units S32, S42 and S52 and S33, S43 and S53.

Figure 3A:
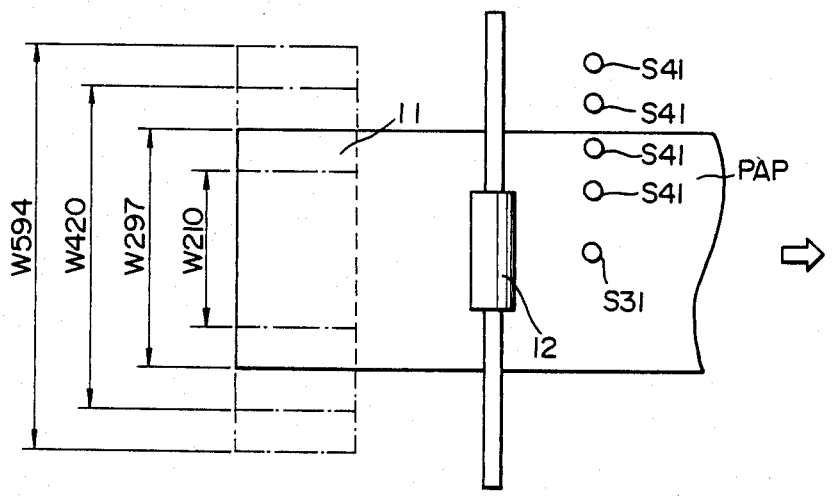
FIG. 3A is a plan view representative of a positional relationship between a paper roll and sensor units.
Figure 3B:
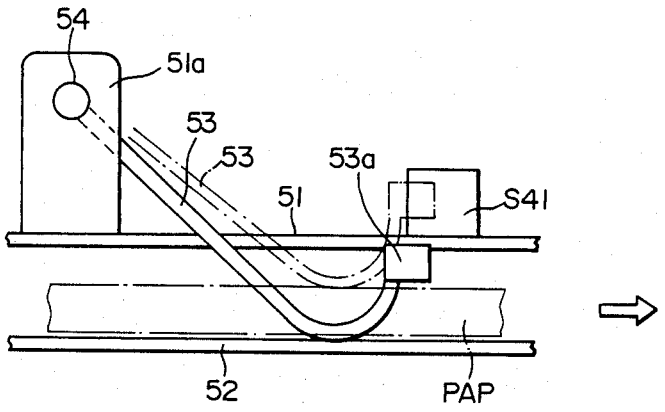
FIG. 3B is an enlarged front view schematically showing one of the sensor units and its neighborhood.

FIG. 3A is a plan view showing a positional relationship between the sensor units S31 and S41. In FIG. 3A, the sensor unit S31 is positioned at the center of a paper (labeled PAP) transport path while the sensor unit S41 is made up of four independent sensors. Implemented as a reflection type optical sensor, the sensor unit S31 determines the kind of the paper PAP in terms of reflectivity. As shown in FIG. 3B, the four sensors of the sensor unit S41 are mounted on a paper guide 51 which defines the transport path for the paper PAP which is paid out from the roll 11. A sensing arm 53 is located in the vicinity of each sensor of the sensor unit S41 and tiltably supported by a shaft 54 on the paper guide 51. The arm 53 has a light intercepting piece 53*a* at its free end. The light intercepting piece 53*a* is positioned such that it protrudes into an optical path of the sensor when the paper PAP exists on a paper guide 52 and retracts therefrom when the paper PAP does not exist on the paper guide 52.

The illustrative embodiment is designed on the assumption that the copier is operable with paper rolls having widths of 210 millimeters, 297 millimeters, 420 millimeters, and 594 millimeters. Since the paper paid out from any of such rolls is transported with its center being aligned with the center of the transport path, the four sensors of the sensor unit S41 are individually disposed at positions slightly short of 105 millimeters, 149 millimeters, 210 millimeters and 297 millimeters as measured from the centerline of the transport path. In this construction, the statuses of electrical outputs of the four sensors change on the basis of the width of a paper roll and, hence, the width of a paper roll can be determined by referencing an electical signal outputted by the sensor unit S41.

Figure 3C:
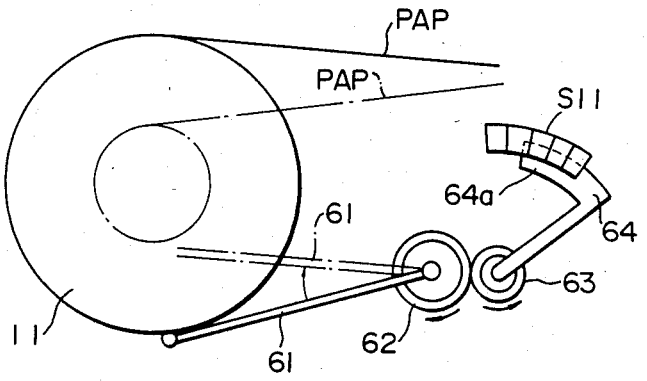
FIG. 3C is a front view schematically showing another sensor unit and its neighborhood.

FIG. 3 shows details of the sensor unit S11 which is located to face the periphery of the roll 11. In the figure, a sensing arm 61 is connected to a rotatable shaft on which a roller 62 is mounted. The arm 61 is constantly biased by a spring, not shown, such that its free end remains in pressing contact with the periphery of the roll 11. Since the diameter of the roll 11 sequentially changes with the amount of remaining paper, the arm 61 tilts on the basis of the amount of remaining paper. A roller 63 is held in contact with the roller 62 while a light intercepting plate 64 is rigidly connected to a shaft on which the roller 63 is mounted. As the arm 61 tilts in response to a change in the diameter of the roll 11, the roller 63 is rotated via the roller 62 to shift the light intercepting plate 64. The sensor unit S11 is disposed in a path along which the plate 64 is movable. The sensor unit S11 is constituted by five transmission type optical sensors which are arranged side by side in the direction of movement of the plate 64. Hence, the combination of statuses of electrical outputs of the five sensors changes with the diameter of the roll 11 so that the amount of remaining paper of the roll 11 can be determined with respect to six different levels by referencing an electrical signal outputted by the sensor unit S11.

The sensor unit S21 is also located to face the periphery of the roll 11 and implemented as a reflection type optical sensor for sensing the presence/absence of the roll 11. The surface of the shaft 15 on which the roll 11 is mounted is painted black while the roll 11 is white. Hence, the level of light incident to the sensor unit S21 noticeably varies depending upon the presence/absence of the roll 11, i.e., the presence/absence of the roll 11 can be determined on the basis of the output level of the sensor unit S21. The sensor units S51, S14, S24 and S34 are adapted to determine the presence/absence of the paper in their particular positions. The sensor units S12, S22, S32, S42 and S52 of the paper feed mechanism 20 and the sensor units S13, S23, S33, S43 and S53 are identical in construction and function with the sensor units S11, S21, S31, S41 and S51, respectively.

Figure 9:
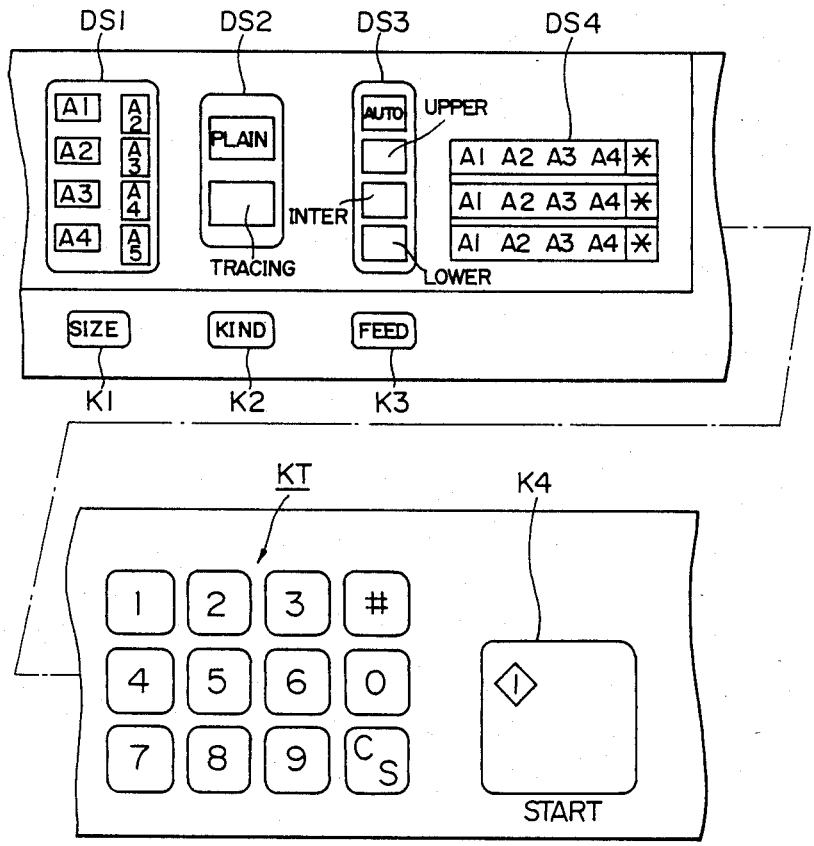
FIG. 9 is a plan view showing a part of an operation board which is included in the copier of FIG. 1.

Referring to FIG. 9, an operation board of the copier which includes the paper feeding section of FIG. 1 is shown in a fragmentary view. As shown, the operation board is provided with a number of key switches K1, K2, K3, K4 and KT and various display units DS1, DS2, DS3 and DS4.

The key switch K1 is used to enter the size of a desired paper. Specifically, every time the key switch K1 is pressed, various sizes or formats are sequentially selected such as A1 (vertically long), A2 (vertically long), A3 (vertically long), A4 (vertically long), A2 (horizontally long), A3 (horizontally) long), A4 (horizontally long), and A5 (horizontally long). The size and orientation selected appear on the display unit DS1. The key switch K2 is adapted to select a particular kind of paper (material). Every time the key switch K2 is pressed, a plain paper and a tracing paper are selected alternately while the kind of paper selected is shown on the display unit DS2. The key switch K3 is accessible for selecting one of the upper, intermediate and lower paper feed mechanisms 10, 20 and 30. Every time the key switch K3 is pressed, the upper paper feed mechanism 10, intermediate paper feed mechanism 20, lower paper feed mechanism 30 and an automatic sheet feed mode are sequentially selected, and the display unit DS3 is associated with this key switch K3. In an initial condition (as well as after resetting) before the depression of the key switch K3, the automatic paper feed mode is selected. The display unit DS4 displays the sizes and kinds of paper rolls which are individually loaded in the paper feed mechanisms 10, 20 and 30. KT is representative of ten keys which are available for entering a desired number of copies, for example. The key switch K4 is a start key for entering a copy start command.

Figure 4A:
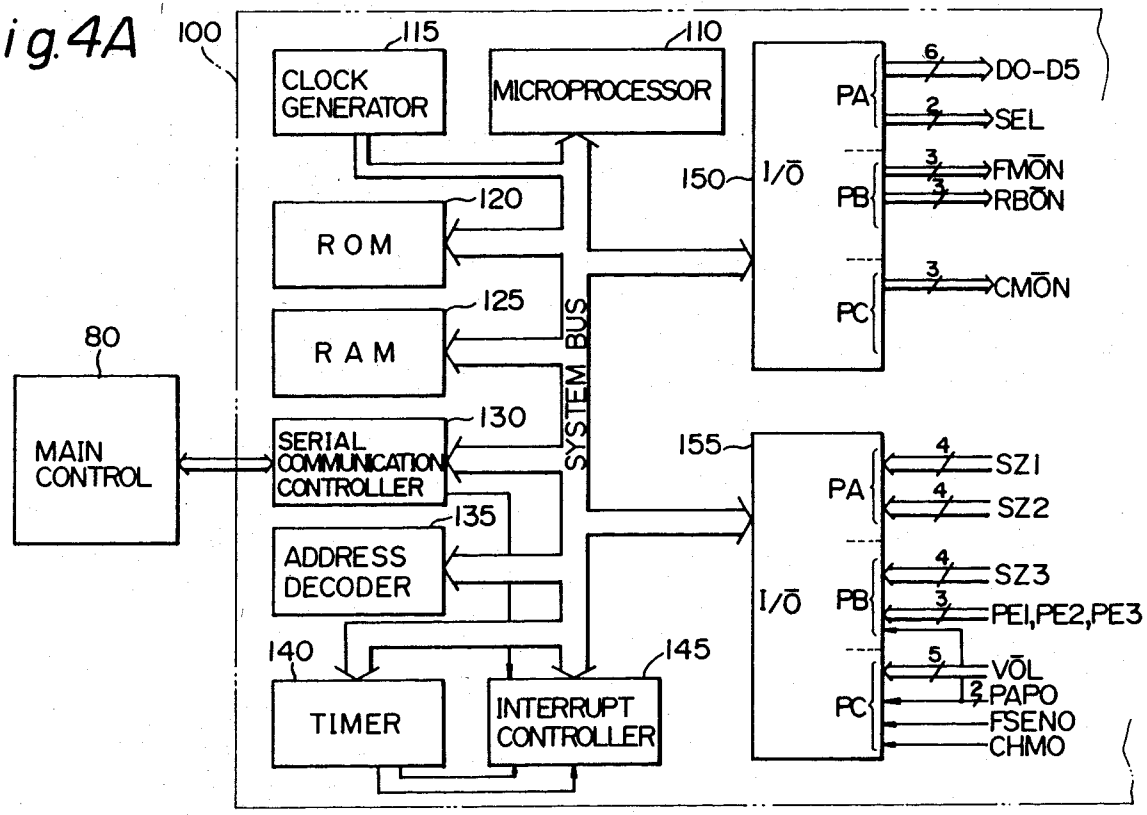
FIGS. 4A and 4B are schematic block diagrams showing, when combined, an electric circuit included in the paper feeding device.
Figure 4B:
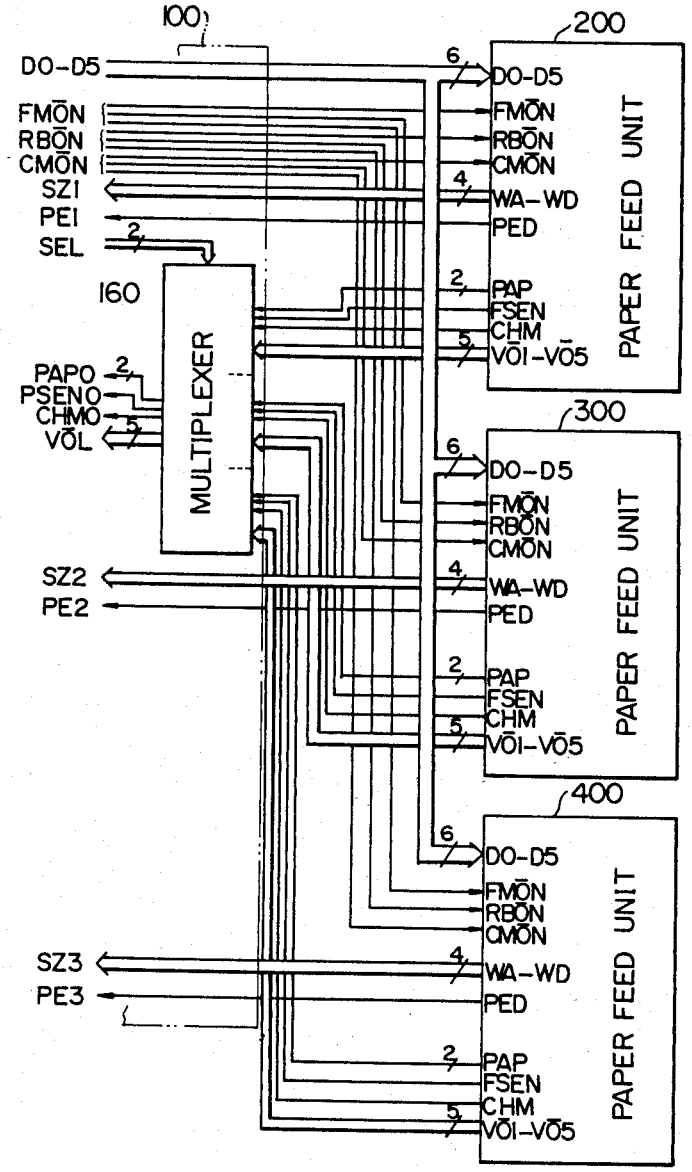

Referring to FIGS. 4A and 4B, an electric circuit associated with the paper supplying device of the copier shown in FIG. 1 is shown. In the figures, a paper feed control unit 100 is connected to three paper feed units 200, 300 and 400 which are associated with the paper feed mechanisms 10, 20 and 30, respectively. The paper feed control unit 100 includes a microprocessor 110, a clock signal generator 115, a ROM 120, a RAM 125, a serial communication controller 130, an address decoder 135, a timer 140, an interrupt controller 145, input/output (I/O) controllers 150 and 155, and a multiplexer 160. The control unit 100 is connected to a main control unit 80 of the copier to receive a paper feed start command, a paper feed mechanism select command, and data including a cutting length of paper.

The clock signal generator 115 delivers a predetermined clock to each of the microprocessor 110, serial communication controller 130, timer 140, etc. More specifically, the timer 140 counts 2.5 megahertz clock pulses from the clock signal generator 115 and in turn applies an interrupt request signal to the interrupt controller 145 at a period of 1 millisecond. The I/O controllers 150 and 155 are each provided with three groups of I/O ports PA, PB and PC each having eight ports, each port being usable for both of input and output. In the illustrative embodiment, all the ports of the I/O controller 150 are assigned to output while all the ports of the I/O controller 155 are assigned to input.

Among the ports of the I/O controller 150, six ports are commonly connected to terminals D0 to D5 of the paper feed units 200, 300 and 400, two ports are connected to a selection signal line SEL of the multiplexer 160, three ports are individually connected to terminals $\overline{FMON}$ of the paper feed units 200, 300 and 400, three ports are individually connected to terminals $\overline{RBON}$ of the paper feed units 200, 300 and 400, and three ports are individually connected to terminals $\overline{CMON}$ of the paper feed units 200, 300 and 400. Among the ports of the other I/O controller 155, four ports are connected to terminals WA to WD of the paper feed unit 200, four ports are connected to terminals WA to WD of the paper feed unit 300, four ports are connected to terminals WA to WD of the paper feed unit 400, three ports are individually connected to terminals PED of the paper feed units 200, 300 and 400, two ports are connected to a signal line PAP0 of the multiplexer 160, five ports are connected to a signal line $\overline{VOL}$ of the multiplexer 160, one port is connected to a signal line FSEN0 of the multiplexer 160, and one port is connected a signal line CHM0 of the multiplexer 160. Three groups of input terminals of the multiplexer 160 are connected to terminals PAP, PSEN, CHM and $\overline{VO1}$ to $\overline{VO5}$ of the paper feed units 200, 300 and 400. One of such three groups of input terminals is selected on the basis of a status of the signal line SEL so that a signal appearing on the signal line SEL appears on the output terminal. For example, when the first group of input terminals is selected, the same signals as those appearing on the output terminals PAP, FSEN, CHM and VO1 to VO5 of the paper feed unit 200 appear on the signal lines PAP0, FSEN0, CHM0 and $\overline{VOl}$, respectively.

Figure 4C:
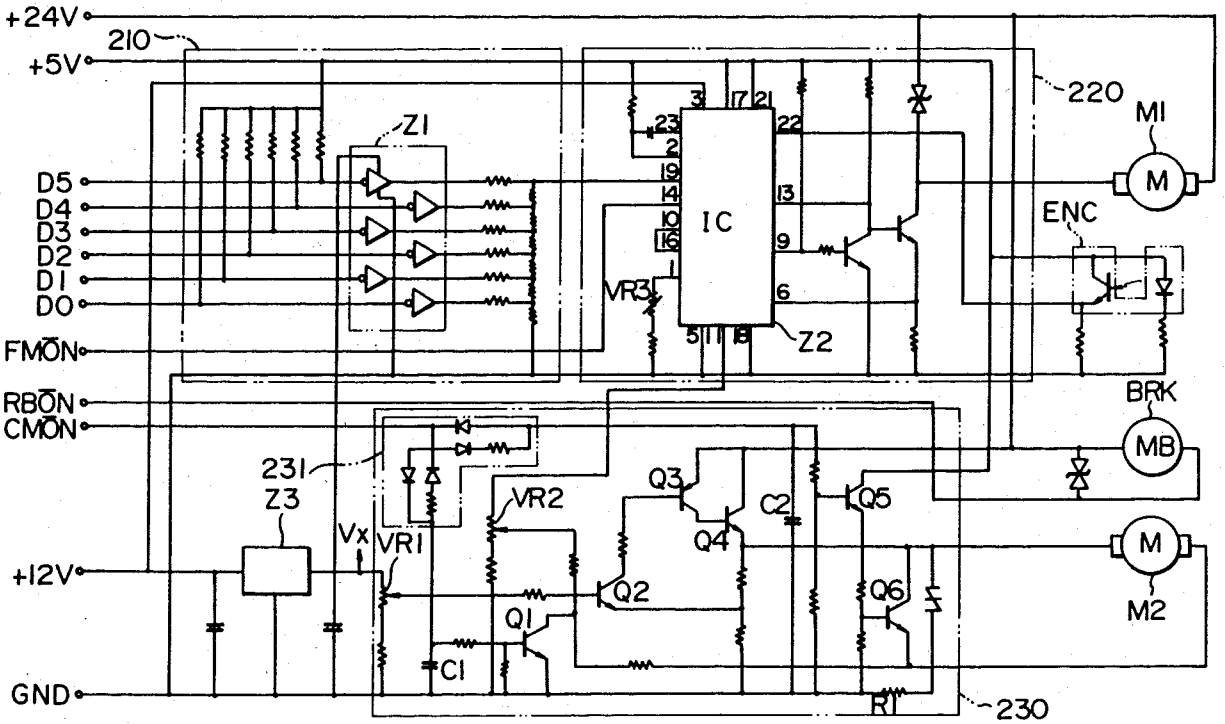
FIGS. 4C and 4D are schematic circuit diagrams showing a paper feed unit in detail.
Figure 4D:
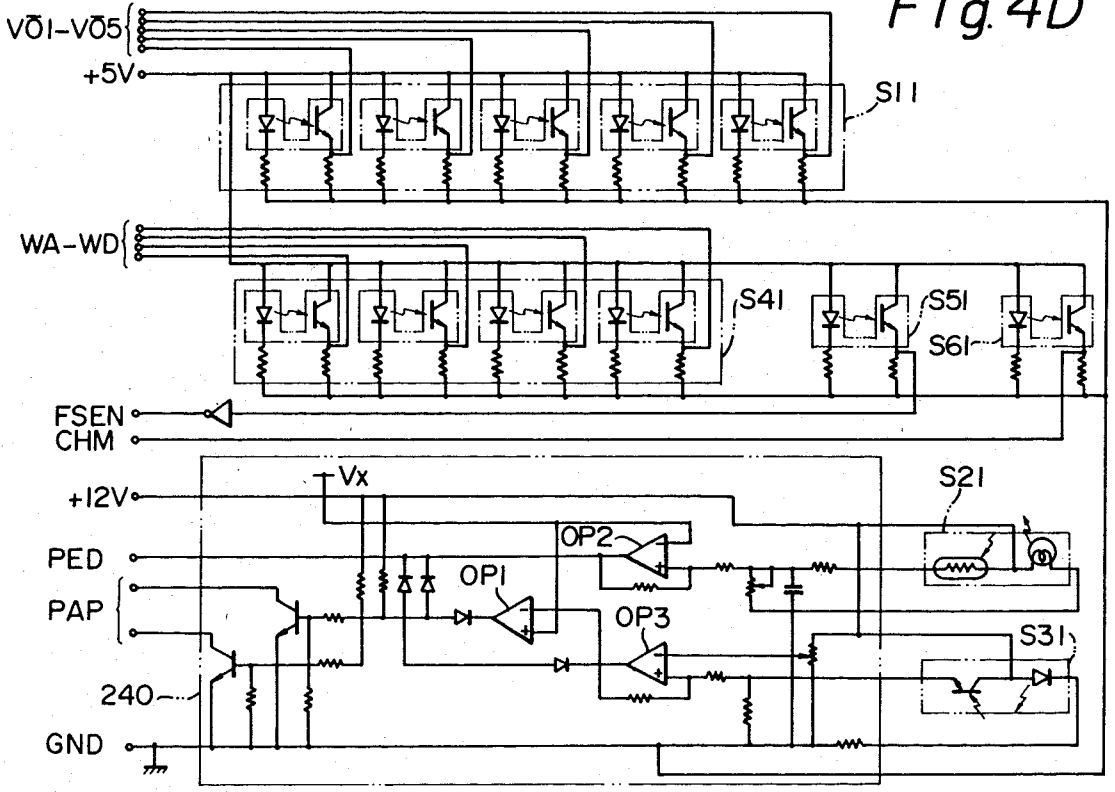

FIGS. 4C and 4D show a specific construction of the paper feed unit 200. As shown, the sheet feed unit 200 includes a digital-to-analog (DA) converting circuit 210, a servo control circuit 220, a motor driving circuit 230, and an analog comparing circuit 240. Implemented by an inverter Z1 and a number of resistors, the DA converting circuit 210 converts a digital signal appearing on input terminals D0 to D5 thereof into an analog signal. The analog signal outputted by the circuit 210 is fed as a speed command signal to the servo control circuit 220. In the illustrative embodiment, the digital signal applied to the DA converting circuit 210 has six bits and, therefore, sixty-four different speed command signals may be produced as needed.

Figure 4E:
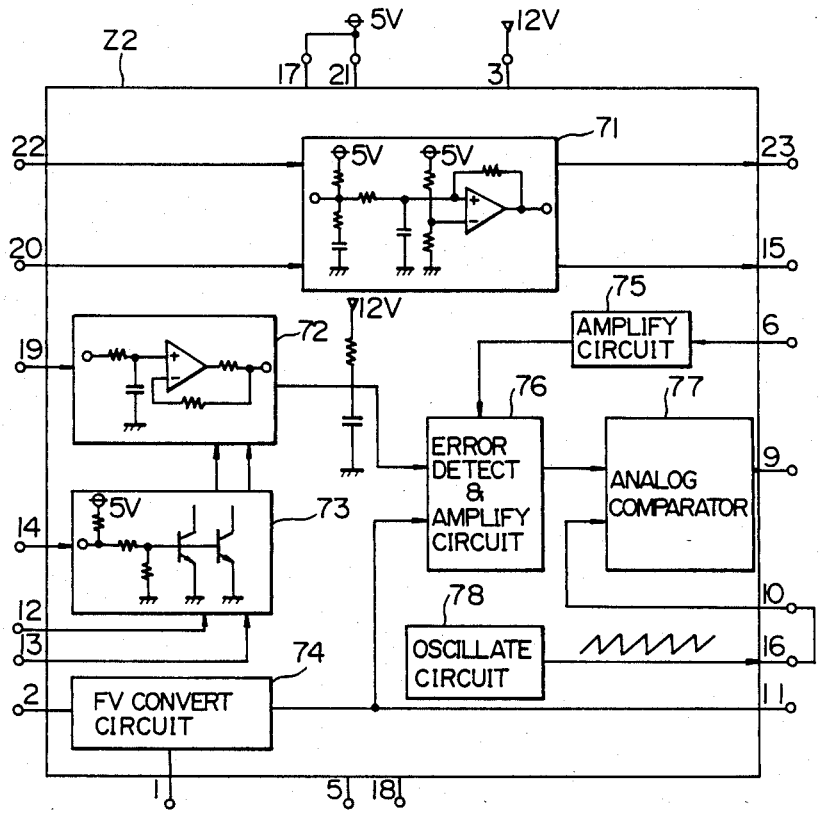
FIG. 4E is a shematic block diagram showing details of an integrated circuit included in the arrangement of FIG. 4C.

The servo control circuit 220 includes an integrated circuit (IC) Z2 and a power amplifying transistor. The IC Z2 comprises a hybrid IC which includes a major part of control elements necessary for the control of a servo motor. As shown in detail in FIG. 4E, the IC Z2 includes a waveform shaping circuit 71, a buffer 72, a level converting circuit 73, a frequency-to-voltage (FV) converting circuit 74, an amplifying circuit 75, an error detecting and amplifying circuit 76, analog comparator 77, and an oscillating circuit 78. The electric motor M1 is connected to an output terminal of the servo control circuit 220. The output shaft of the motor M1 is drivably connected to the shaft of the feed roller 16. Implemented as a DC servo motor, the motor M1 has an output shaft to which a disk of a rotary encoder is connected. The rotation of the disk is sensed by a transmission type optical sensor ENC. The sensor ENC comprises a light emitting diode and a phototransistor and produces one pulse every time the disk is rotated by a predetermined amount.

The output signal of the sensor ENC is fed back to the servo control circuit 220 to serve as a rotation signal associated with the motor M1. In the circuit 220, the rotation signal is applied to the FV converting circuit 74 via the waveform shaping circuit 71 and, therefore, a voltage or velocity feedback voltage associated with the rotation speed of the motor M1 appears on an output terminal of the FV converting circuit 74. The error detecting and amplifying circuit 75 delivers to the comparator 77 a voltage associated with a difference between a voltage which is outputted by the DA converting circuit 210 and the feedback voltage. The comparator 77 then produces a binary signal by comparing the output voltage of the circuit 76 and a voltage outputted by the oscillating circuit 78 and having a saw-toothed waveform. The binary signal is amplified by two transistors which are connected to the IC Z2 with respect to power so as to on-off control the motor M1.

When the actual rotation speed of the motor M1 is lower than a target speed (associated with a speed command signal), the output level of the error detecting and amplifying circuit 76 increases to increase the duty of the binary signal which appears on the output of the comparator 77. As a result, the level for energizing the motor M1 is increased to accelerate the motor M1. Conversely, when the actual speed of the motor M1 is higher than the target speed, the output level of the error detecting and amplifying circuit 76 decreases to reduce the duty of the binary signal and, hence, the motor energizing level is lowered to decelerate the motor M1. In any case, the the servo control circuit 220 controls the motor M1 to equalize the actual and target motor speeds. The drive of the motor M1 is on-off controlled by a signal which is applied to a pin #14 of the IC Z2, i.e., terminal FM$\overline{\text{ON}}$. It is to be noted that a semifixed resistor VR3 is connected to a pin #1 of the IC Z2 and used to adjust the relationship between the speed command signal and the motor speed.

The motor M2 is connected to an output terminal of the motor driving circuit 230. The motor M2 is implemented as a DC servo motor, but it is not provided with a rotary encoder. The motor driver 230 is provided with a servo control circuit which is simpler than the IC Z2. Specifically, the motor drive 230 is provided with a circuit for sensing a current flowing through the motor M2 by means of a resistor R1, feeding back a signal associated with the sensed current to th base terminal of a transistor Q2 to adjust a current to flow through the motor M2, and thereby stabilizing the rotation of the motor M2. The motor M2 is on-off controlled by a signal which is applied to the terminal CM$\overline{\text{ON}}$. More specifically, when the terminal CMON has a low level, a transistor Q1 is turned off, the transistor Q2 is turned on, a transistor Q3 is turned on, and a transistor Q4 is turned on. In this condition, a current flows from one end (+24 volts) to the other end (ground or GND) of a power supply line to energize the motor M2.

The level for energizing the motor M2 changes with the level of current which flows through the base terminal of the transistor Q2. In the illustrative embodiment, a current associated with the output voltages of variable resistors VR1 and VR2 and the terminal voltage of the resistor R1 is caused to flow through the base terminal of the transistor Q1. One end of the variable resistor VR1 is connected to ground via a resistor while a fixed voltage Vx (+5 volts) produced by a 3-terminal regulator is applied to the other end of the variable resistor VR1. The variable resistor VR2 is connected at one end to ground via a resistor and at the other end to a pin #11 of the IC Z2. Appearing on the pin #11 of the IC Z2 is a voltage which is associated with the rotation speed of the motor M1. Hence, the current flowing through the base terminal of the transistor Q2 is adjustable as desired by operating the variable resistors VR1 and VR2. Further, this current is variable with the rotation speed of the motor M1.

In this particular embodiment, a paper is cut while being sequentially paid out from a roll and, hence, the cutting line is inclined relative to the axis of a cutter, as previously stated. However, since the cutter assembly 13 is inclined complementary to and in the opposite direction to the inclination of the cutting line, the cutting line becomes perpendicular to the direction of paper feed when the inclination of the cutter assembly 13 is the same as the inclination of the cutting line relative to the cutter axis. A problem arises here is that the diameter of the feed roller 16 suffers from machining errors and, therefore, the actual paper transport rate of the feed roller 16 differs from one apparatus to another even when the motor M1 is driven at the same speed. When the cutting speed of the cutter is constant, a change in paper transport speed results in a change in the inclination of the cutting line relative to the axis of the cutter assembly. Further, the inclination of the cutter asssembly is apt to differ from one apparatus to another due to machining errors. In this particular embodiment, the relationship between the level of the speed command signal and the rotation speed of the motor M1 is adjustable by using the variable resistor VR3 so as to compensate for the irregularity in the diameter of the feed roller 16. Further, the speed of the motor M2 and therefore the paper cutting speed is adjustable by using the variable resistors VR1 and VR2. Since both of a paper feed speed Vf and a cutting speed Vc are adjustable as mentioned above, the angle of inclination of the cutting line relative to the axis of the cutter assembly can be adjusted as desired. This is successful in compensating for the scattering among products with respect to dimensions and position and thereby equalizing the inclination of the cutting line relative to the axis of the cutter assembly and the inclination of the cutter assembly itself.

It is sometimes desired to change the paper feed speed in conformity to a change in the speed of a recording apparatus or a change in the specification of a paper feeding device itself. Assuming that the paper cutting speed is constant, any change in paper feed speed, i.e., in the rotation speed of the feed roller 16 causes the inclination of the actual cutting line relative to the axis of the cutter assembly to change. In the illustrative embodiment, however, a current associated with the rotation speed of the motor M1 flows through the base terminal of the transistor Q2 so that the drive speed of the motor M2 is changed on the basis of that current. More specifically, the drive speed of the motor M2 is controlled to remain proportional to the drive speed of the motor M1. So long as such two motor drive speeds are proportional to each other, the inclination of the cutting line relative to the axis of the cutter assembly is not changed even when the drive speed of the motor M1 is changed. That is, even when the setting of the speed command signal associated with the motor M1 is changed, the inclination of the cutting line relative to the cutter assembly and the inclination of the cutter assembly itself are not deviated from each other, preventing the paper from being cut obliquely. This is also true when the rotation speed of the motor M1 is affected by a change in load, for example. The variable resistor VR2 is operable to change the ratio between a change in the rotation speed of the motor M1 and a change in the rotation speed of the motor M2. The variable resistor VR2 is set during adjustment such that the drive speed of the motor M2 is proportional to the drive speed of the motor M1.

In the illustrative embodiment, two variable resistors VR1 and VR2 are used to adjust the speed of the cutter drive motor M2. Alternatively, when the speed signal voltage appearing in the pin #11 of the IC Z2 does not include an offset voltage, the variable resistor VR1 may be omitted.

On the other hand, when the terminal CMON has a high level, the transistor Q1 is turned on, the ransistor Q2 is turned off, the transistor Q3 is turned off, and the transistor Q4 is turned off, interrupting the energization of the motor M2. In this case, both of the transistors Q5 and Q6 are turned on, the voltage developed across the terminals of the motor M2 is absorbed by the transistor Q6. In this sense, the transistors Q5 and Q6 serve as a braking circuit which sharply brakes the motor M2 upon the stop of drive of the motor M2. However, the on-off control timing associated with the motor M2 and that associated with the braking circuit are not coincident, as follows. When the terminal CMON has a high level, the motor M2 is stopped and the braking circuit (Q5, Q6) is in an ON state. As the terminal CMON has a low level, the charge stored in a capacitor C2 is immediately discharged via a diode of a signal processing circuit 231 with the result that the braking circuit is immediately turned into an OFF state. However, the charge stored in a capacitor C2 is discharged by way of a series connection a diode and a resistor of the signal processing circuit 231, taking a substantial period of time. Hence, when the terminal CMON becomes low level, the transistor Q1 is turned off and therefore the motor M2 is turned on upon the lapse of a predetermined period of time after the braking circuit has been turned off.

When the terminal CMON is turned into a high level, the charge stored in the capacitor C1 is immediately discharged via the diode of the signal processing circuit 231 and, therefore, the motor M2 is immediately deenergized. However, the charge stored in the capacitor C2 is discharged by way of the series connection of a diode and a resistor of the signal processing circuit 231, taking a substantial period of time. Hence, the transistors Q5 and Q6 are turned on to activate the braking circuit associated with the motor M2 when a predetermined period of time elapses after the stop of the motor M2. The electromagnetic brake BRK is connected to the shaft 15 on which the paper roll 11 is mounted for the purpose of braking the rotation of the paper roll 11. A driver is connected between the terminal of the brake BRK and the control terminal RBON, although not shown in the figure.

As shown in FIG. 4D, the sensor unit S11 is made up of five transmission type optical sensors each comprising a light emitting diode and a phototransistor. The output terminals of the five sensors are individully connected to the terminals VO1 to VO5. The sensor unit S41 is constituted by four transmission type optical sensors each comprising a light emitting diode an a phototransistor, the output terminals of the sensors being individually connected to the terminals WA to WD. The sensor units S51 and S61 each comprises a single transmission type optical sensor and connected at their output terminals to the terminals FSEN and CHM. The sensor unit S61 is adapted to sense the home position of the rotary blade 1 of the cutter assembly 13. The sensor units S21 and S31 are each implemented as a reflection type optical sensor. The sensor unit S21 comprises a bulb and a cadmium sulfide (CdS) cell while the sensor unit S31 comprises a light emitting diode and a phototransistor. The output terminals of the sensor units S21 and S31 are commonly connected to the input terminal of an analog comparing circuit 240.

In the analog comparing circuit 240, a voltage associated with the resistance of the CdS cell of the sensor unit S21 is generated and compared with a predetermined voltage by an operational amplifier (OP AMP) OP2. A binary signal representative of the result of comparison appears on the terminal PED, and a status of this signal is associated with the presence/absence of a paper roll. The current flowing through the phototransistor of the sensor unit S31 is converted into a voltage and then compared with a predetermined voltage by an OP AMP OP3. A binary signal representative of the result of comparison is fed to one of the two terminals PAP via a transistor. The binary signal outputted by the OP AMP OP3 is inverted by an OP AMP OP1 and then fed to the other terminal PAP via a transistor. Therefore, when one of the two terminals PAP has a low level, the other has a high level. The levels of these terminals PAP are variable depending upon the kind of a paper roll which the sensor unit S31 senses. More specifically, the levels at the terminals PAP are set in binary levels depending upon whether the paper roll mounted is a plain paper or a tracing paper.

Figure 5A:
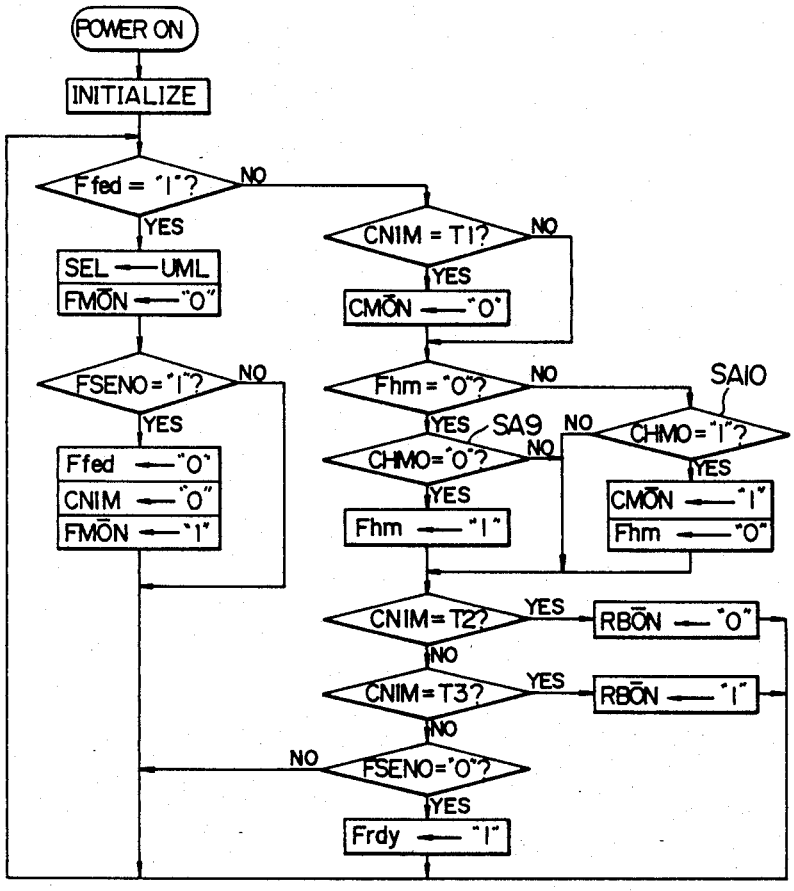
FIGS. 5A, 5B and 5C are flowcharts outlining the operation of a miroprocessor which is included in the arrangement of FIG. 4A.
Figure 5B:
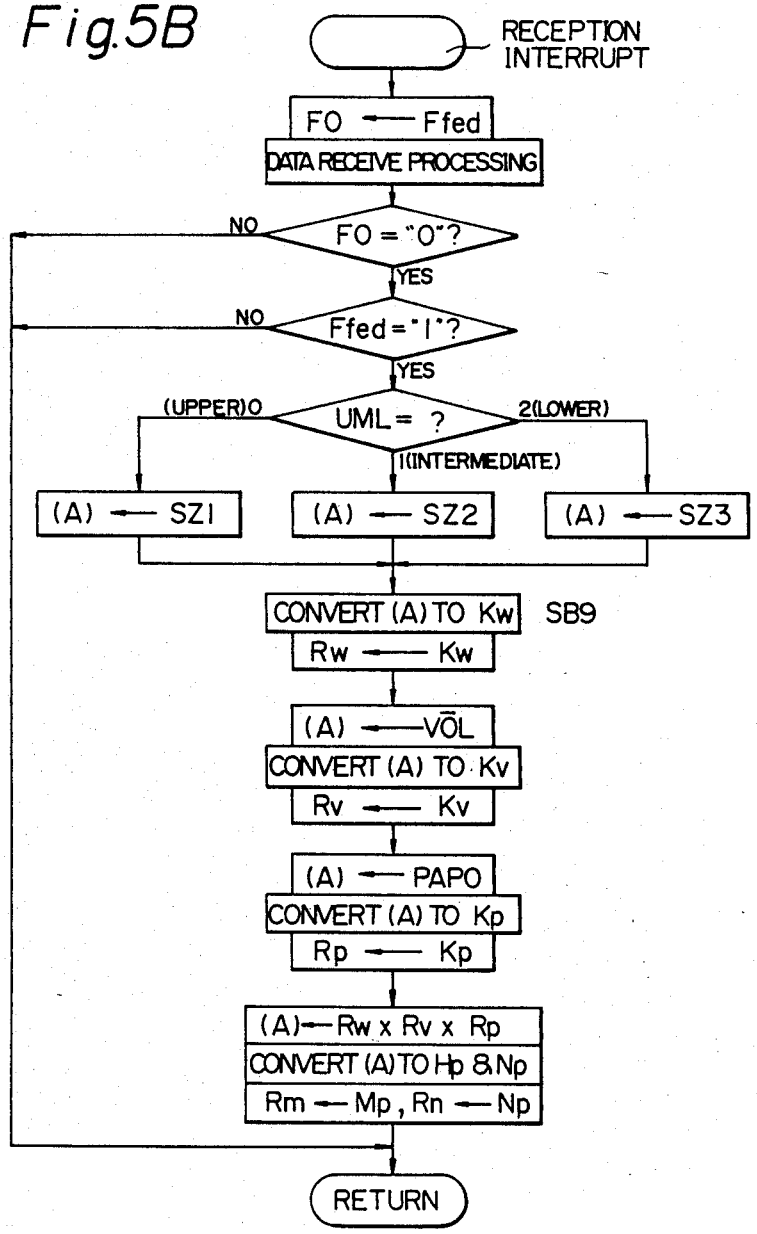
Figure 5C:
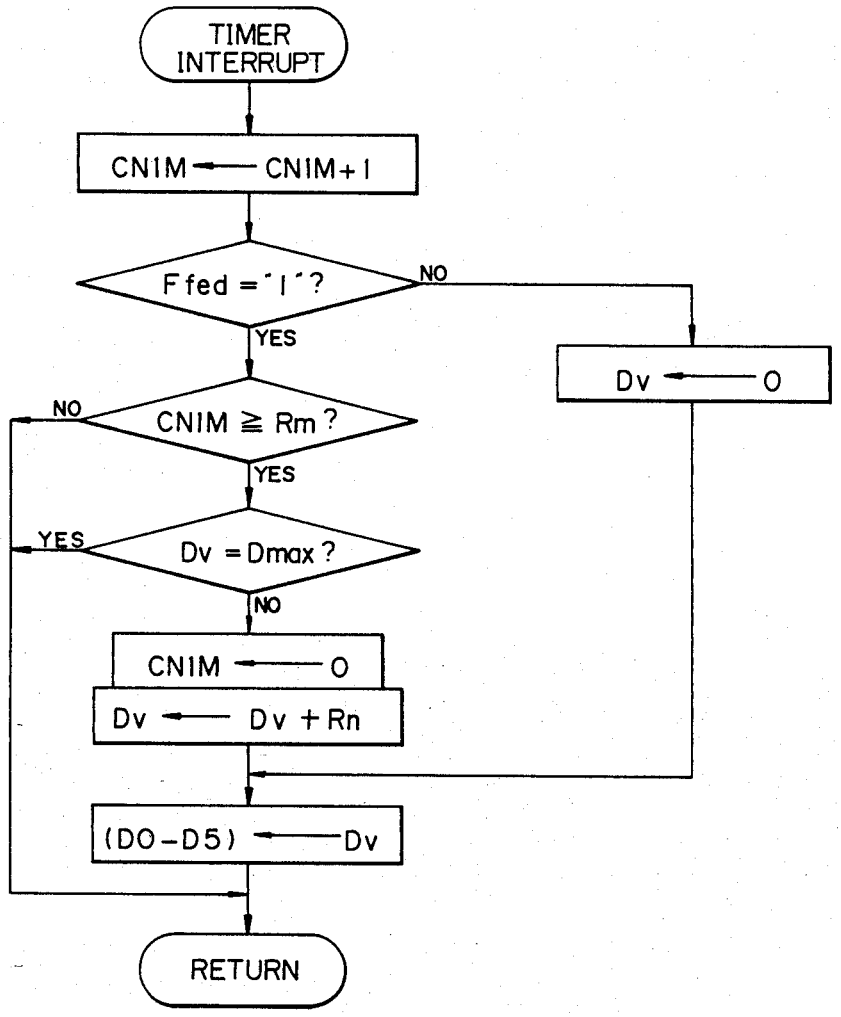

Referring to FIGS. 5A, 5B and 5C, a specific operation of the microprocessor 110 of FIG. 4A is shown in flowcharts. Specifically, FIGS. 5A, 5B and 5C demonstrate a main routine, a reception interrupt routine, and a timer interrupt routine, respectively. The reception interrupt routine is executed when the serial communication controller 130 delivers an interrupt request to the microprocessor 110 in response to data which are fed thereto from the main control unit 80. The timer interrupt routine is executed when the timer 140 delivers an interrupt request to the microprocessor 110. In the illustrative embodiment, the timer 140 periodically produces an interrupt request every 1 milliseconds.

As shown in FIG. 5A, when a power switch of the copier is turned on, the entire circuitry is initialized. Specifically, the memory 125 is cleared, the various control units 130, 140, 145, 150, 155 and 160 are restored to their predetermined statuses, and the statuses of the output ports are initialized. By such initialization, the serial communication controller 130 is prepared for communications with the main control unit, the timer 140 is conditioned to generate a signal every 1 millisecond, and the interrupt controller 145 is conditioned to control the interruption to the microprocessor 110 in response to interrupt requests form the serial communication controller 130 and timer 140. Then, a flag Ffed indicative of whether paper feed is under way is checked. The flag Ffed is set or made a (logical) ONE by data which is fed from the main control unit 80, which is connected to the serial communication controller 130 serial signal line, and becomes a (logical) ZERO when the sensor S51 (or S52 or S53) located downstream of the pull-out roller senses a paper roll.

While a sheet feed command from the main control unit 80 is absent, the flag Ffed is a Zero and the program awaits until it becomes a ONE. As the flag Ffed becomes a ONE, the content of a register UML is fed to the signal line SEL to turn the terminal FMON to a ZERO (low level). The content of the register UML is set by data which is fed from the main control unit 80 and is indicative of one of the paper feed mechanisms 10, 20 and 30 which is selected. Hence, signals on the terminals PAP, FSEN, CHM and VOL1 to VO5 associated with the paper feed unit selected by the main control unit 80 appear on the signal lines PAP0, FSEN0, CHM0 and VOL, respectively. When the terminal FMON is turned into a ZERO, the motor M1 associated with the feed roller 16, 26 or 36 begins to rotate. Initially, however, the speed command signal has a zero speed status.

In the reception interrupt routine shown in FIG. 5B, the content of the flag Ffed is transferred to a flag FO and, then, data reception processing is executed. In this processing, data stored in a receive register of the serial communication controller 130 is fetched and discriminated. Based on the result of discrimination, the flag Ffed and the various registers (including UML and a cutting length register) are individually loaded with data. Further, various kinds of data associated with the paper feeding device are transmitted to the main control unit 80. Immediately after a paper feed command has appeared, the flag FO is a ZERO and the flag Ffed is a ONE. At this instant, the content of the register UML is checked. If the content of the register UML is "0", "1" and "2", internal registers (A) are individually loaded with the contents of signal lines SZ1, SZ2 and SZ3. More specifically, the registers (A) are loaded with data which are associated with the widths of paper rolls mounted in the paper feed mechanisms which may be selectively operated.

In the illustrative embodiment, when the feed roller 16, 26 or 36 begins to rotate, its speed is caused to increase stepwise in order to prevent the feed roller from slipping on a paper roll. Since the force necessary for changing the speed at which a paper roll is pulled is proportional to the mass of the roll, changing the degree of acceleration in matching relation to the mass of a roll is successful in reducing the time necessary for raising the driving speed within a range which does not cause slippage. The mass of a roll is dependent upon the width, diameter and material of the roll. In this embodiment, therefore, parameters Kw, Kv and Kp representative of relationships between the width, diameter (remaining amount) and material (kind) of a roll and the mass of a roll are individually stored in the ROM 120 in the form of tables.

In a step SB9 shown in FIG. 5B, the table with parameter Kw is accessed on the basis of roll width data lodged in the register (A) so as to load the register (A) with Kw which is associated with the content of the register (A). The content of the register (A) is stored in a register Rw. Next, the content of the signal line VOL is loaded in the register (A) and, then, the table with parameter Kv is referenced to load the register (A) with Kv which is associated with the content of (A). The content of (A) is loaded in a register Rv. Further, the content of the signal line PAP0 is loaded in the register (A) and, then, the table with parameter Kp is referenced to load the register (A) with Kp which is associated with the content of (A). The content of (A) is stored in a register Rp. The contents of these registers Rw, Rv and Rp are multiplied and the resulting product is lodged in the register (A). By referencing a table in which a relationship between the mass and acceleration parameters Mp and Np is listed, parameters Mp and Np associated with the content of the register (A) are obtained. These parameters Mp and Np are stored in registers Rm and Rn, respectively.

Figure 7:
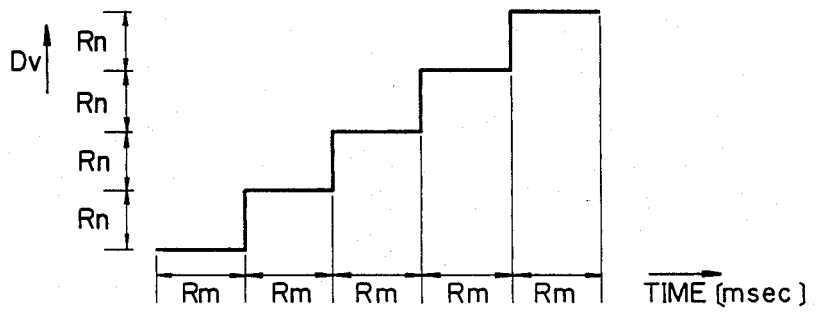
FIG. 7 is a timing chart demonstrating changes in velocity command data which occur during acceleration.

Referring to FIG. 7, there is shown the variation of speed command data Dv which is associated with the drive speed of the feed roller. As shown, the speed command data DV is added up by the content of the register Rn and updated, at a period which is associated with the content of the register Rm. More specifically, the acceleration characteristic of the feed roller and therefore the interval between the start of drive and the rotation at a steady speed, i.e., buildup time is determined by the contents of the registers Rm and Rn. In this embodiment, the buildup time is selected to be 500 milliseconds when the roll width is 594 millimeters, the roll diameter is level 5 (largest), and the paper is a tracing paper. The buildup time is selected to be 117 milliseconds when the roll width is 420 millimeters, the roll diameter is level 2, and the paper is a plain paper. Such a buildup time is proportional to a value produced by $Rw \times Rv \times Rp$. By adjusting the acceleration characteristic based on the mass of a paper roll as mentioned, it is possible to maintain the force acting between the feed roller and the paper roll substantially constant. If such a force is smaller than a magnitude which causes slippage, no slippage will occur despite any change in the width, remaining amount and/or kind of the paper roll. When this force is selected to be slightly smaller than the magnitude which causes slippage, the buildup time can be minimized within the range which does not entail slippage so as to reduce the paper feeding time.

Referring to FIG. 5C, the timer interrupt routine begins with incrementing a counter CN1M for counting time by 1. Then, the flag Ffed is checked and, if it is a ONE indicative of the fact that sheet feed is under way, the content of the counter CN1M is compared with that of the register Rm. If the counter CN1M is greater than the register Rm, the speed command data Dv is checked to see its value. If the the data Dv is short of a value Dmax representative of a steady speed, the counter CN1M is reset to "0" and the content of the register Rn is added to the data Dv to thereby update the data Dv. The resulting data Dv is fed to the signal lines D0 to D5. More specifically, since the timer interrupt routine is repeated every 1 millisecond, the increment (content of Rn) is added to the speed command data at a period which is Rm times longer than than 1 millisecond when the flag Ffed becomes a ONE. In this manner, the speed command data is updated stepwise until the result of updating reaches Dmax as shown in FIG. 7. As soon as the flag Ffed becomes a ZERO, the data Dv is cleared to become "0".

Figure 6:
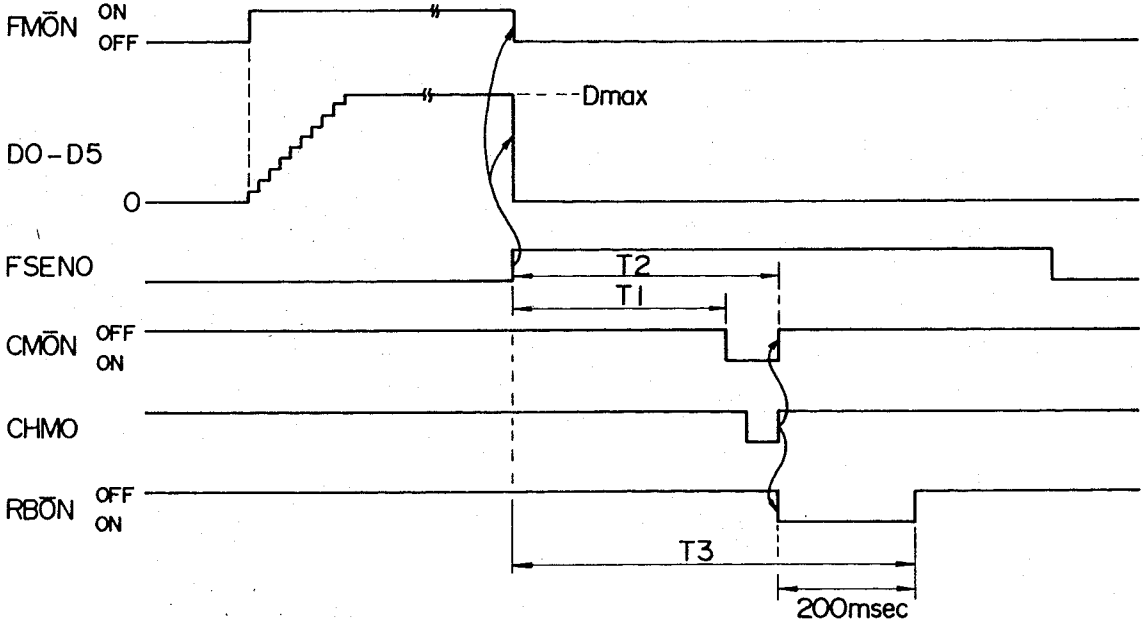
FIG. 6 is a timing chart showing examples of signals which appear in various parts of FIG. 4A.

The main routine shown in FIG. 5A will be further described with reference to the timing chart of FIG. 6. When the flag Ffed becomes a ONE, a signal $\overline{FMON}$ for commanding the drive of the feed roller becomes ON (ZERO) so that the level of speed command data appearing on the signal lines D0 to D5 is sequentially increased stepwise, i.e., the drive speed is increased stepwise. When the speed command data reaches Dmax, it is not updated any further and the acceleration drive mode is replaced with a steady drive mode. At the instant when the sensor unit S51, S52 or S53 located downstream of the feed roller senses the paper, the sinal line FSEN0 becomes a ONE (high level). Then, the microprocessor resets the flag Ffed to a ZERO, clears the counter CN1M to "0", and makes the feed roller drive signal FMON a ZERO (OFF).

As the flag Ffed becomes a ZERO, the speed command data is turned into "0" by the timer interrupt routine, as shown in FIG. 4C. In the main routine, the following procedure is executed when the flag Ffed becomes a ZERO. Specifically, the content of the counter CN1M is compared with a time T1. Since the counter CN1M has been cleared when the signal PSEN0 has become a ZERO, i.e., when the sensor unit S51, S52 or S53 has sensed the leading edge of the paper, the counter CN1M is counting time from that instant. The predetermined time T1 is a duration produced by subtracting from a preselected length of paper a period of time which is associated with the distance between the cutting axis of the cutter assembly 13 and the sensing position of the sensor unit S51. Hence, when the cutter assembly 13 is actuated at the instant when the counter CN1M reachs T1, the paper paid out from the roll will be cut at the predetermined length. The length of paper is specified by the main control unit 80 and may be specified in any of three different modes as with a prior art roll paper feeding device: a first mode in which the size of an original document is sensed and a paper is cut at a length which is associated with the document size (synchronous cutting mode), a second mode in which a paper is cut at a length which is associated with a particular regular size which is selected by an operator out of a plurality of regular sizes, and a third mode in which a paper is cut at a length which is numerically selected by an operator through ten keys, for example.

When the counter CN1M reaches T1, a cutter drive signal CMON is made a ZERO (ON) to thereby start driving the motor M2. Immediately after the drive of the motor M2, the flag Fhm is a ZERO. In this instance, the program is transferred to a step SA9 to see the status of the signal line CHM0. When the signal line CHM0 becomes a ZERO, the flag Fhm is set to a ONE. Then, the program advances to a step SA10 to see the status of the signal line CHM0. If the line CHM0 is a ONE, the cutter drive signal CMON is turned into a ONE (OFF) and the flag Fhm is reset to a ZERO. More specifically, after the cutter drive signal CMON has become a ZERO, it is restored to a ONE when the output signal CHM0 of the home position sensor associated with the cutter assembly 13 becomes a ONE after the change from a ONE to a ZERO.

When the counter CH1M reaches T2, a roll brake ON signal RBON is made a ZERO (ON) to energize the electromagnetic brake BRK with the result that the rotation of the roll is braked. The time T2 is so selected as to coincide with a time at which 80 milliseconds expire after the start of drive of the cutter motor M2 (i.e. T2=T1+80 milliseconds). As the counter CN1M reaches T3, the roll brake ON signal RBON is set to a ONE (OFF). The time T3 is so selected as to coincide with a time at which 200 milliseconds expire after the change of the brake ON signal to a ONE (i.e. T3=T2+200 milliseconds). When the sensor unit S51 senses the trailing edge of the cut sheet, i.e., when the signal line FSEN0 becomes a ZERO, a READY flag Frdy is set to a ONE. Flag Frdy data is transmitted to the main control unit 80.

In the illustrative embodiment, the feed roller drive motor M1 is deenergized as soon as the sensor unit S51 senses the leading edge of the paper, as stated earlier. Hence, in the case where the paper is cut at a position relatively remote from the leading edge of the paper, the paper is cut while being driven by the pull-out roller 14. Since the drive system for the pull-out roller 14 is independent of the drive system for the feed roller 16, the inclination of the actual paper cutting axis relative to the cutting axis of the cutter assembly 13 in the above condition is determined by the drive speed of the pull-out roller 14 and the cutting speed of the asssembly 13. However, even when the feed roller is not driven and if the paper has not been cut and is moving, the motor M1 is rotated at the same speed as the paper. Therefore, the drive speed of the paper is sensed by the rotary encoder ENC and then converted into a speed feedback signal by the FV converter circuit 74. Based on the speed feedback signal, the speed of the cutter motor M2 is automatically adjusted. In this manner, even when the drive of the feed roller is interrupted, the cutter motor M2 is automatically controlled such that the inclination of the paper cutting axis relative to the cutting axis of the cutter assembly 13 remains equal to the inclination particular to the cutter asssembly 13.

Referring to FIG. 10A, the copier control performed by the main control unit 80 of FIG. 4A is outlined. As shown, when the power switch of the copier is turned on, a step SA1 for CPU initialization is executed. In this step, the main control unit 80 initializes itself by clearing a RAM, not shown, initializing various modes, and resetting output ports. The step SA1 is followed by a step SA2, i.e., initial set processing for initializing the conditions (operation modes) of various control boards and the like which are connected to the main control unit 80. Also, a mode and a value of a timer, not shown, are set. In a step SA3, wait mode processing is performed. At this instant, the copier remains in a standby condition with its operation being inhibited. More specifically, the wait mode processing begins with reading the statuses of signals which are fed to various input ports of the main control unit 80 and then storing the results in the RAM. Subsequently, the main control unit 80 delivers a group of output control data which are stored in the RAM beforehand to output ports which are individually assigned to those data, thereby controlling various units which are connected to the output ports. Further, the main control unit 80 checks the statuses of the various input ports which have been read and stored in the RAM so as to find out unusual conditions. If any unusual condition is found, the program is transferred to predetermined failure processing. If no failure is found, the main control unit 80 determines the statuses of the other input ports and, for example, processes data which are entered on the operation board of FIG. 9 while reading display data out of the RAM at predetermined timings to display them on the display units of the operation board.

The above-stated wait mode processing is repeated until a READY state is reached or until the print start key K4 is turned on (step SA4). The READY state will not be set up when the fixing temperature does not lie in a predetermined range and/or when any trouble is detected. When the print start key K4 is pressed under the READY state (step SA5), precopying mode processing shown in a step SA6 is executed to start driving the main motor, to apply precopying cleaning to the photoconductive drum, to perform sheet feed processing, etc. In the next step SA14, the main control unit 80 determines whether an automatic paper feed mechanism selection mode has been set up. For example, if the paper feed key K3 is not depressed, the program advances to a step SA15 because an automatic paper feed mechanism selection mode has been set up. However, if the key K3 is pressed to select any of the upper, intermediate and lower paper feed mechanisms 10, 20 and 30, the program advances to a step SA16. In the step SA16, the paper feed mechanism 10, 20 or 30 specified through the key K3 is selected. The automatic paper feed selection subroutine shown in a step SA15 will be described later.

Subsequently, a step SA7 is executed for causing an actual copying process to occur. The copy mode processing of this step SA7 includes copying process control, paper transport control, failure check control, etc. In the copying process control, the various process elements are each on-off controlled at a predetermined timing which is synchronous to pulses which a timing pulse generator produces in association with the rotation of the main motor. When a plurality of copies are to be produced continuously, the copying mode processing of the step SA7 is repeated. When the copying mode processing of the step SA7 is completed for the last copy, the content of a copy counter Ccopy agrees with that of a set number register Nset so that the program is transferred to postcopying mode processing of a step SA12. This step SA12 is adapted to discharge a copy, to apply postcopying cleaning to the photoconductive drum, etc. Upon the discharge of a copy, the program returns to the wait mode processing of the step SA3.

Figures 1, 10, 10B:
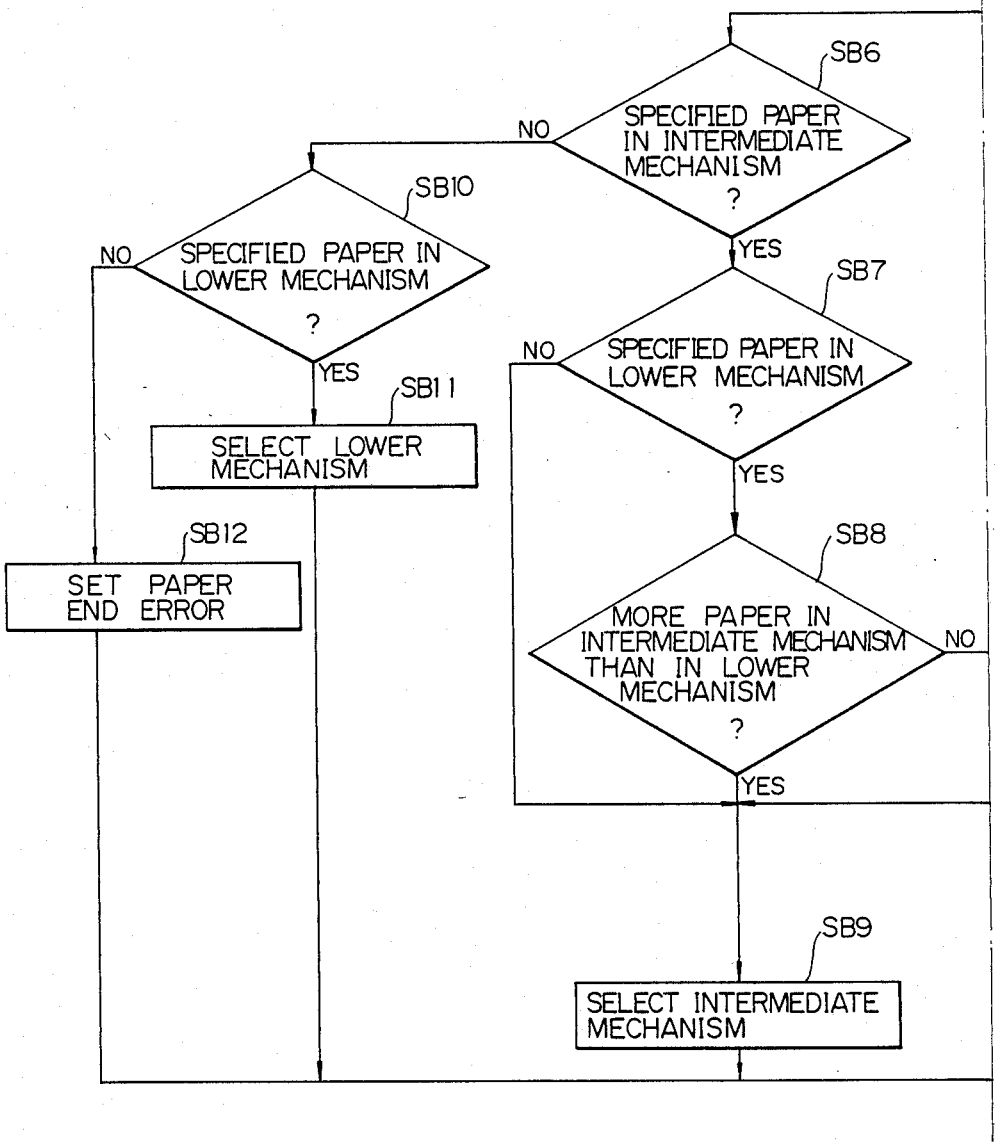
Figures 2, 10B:
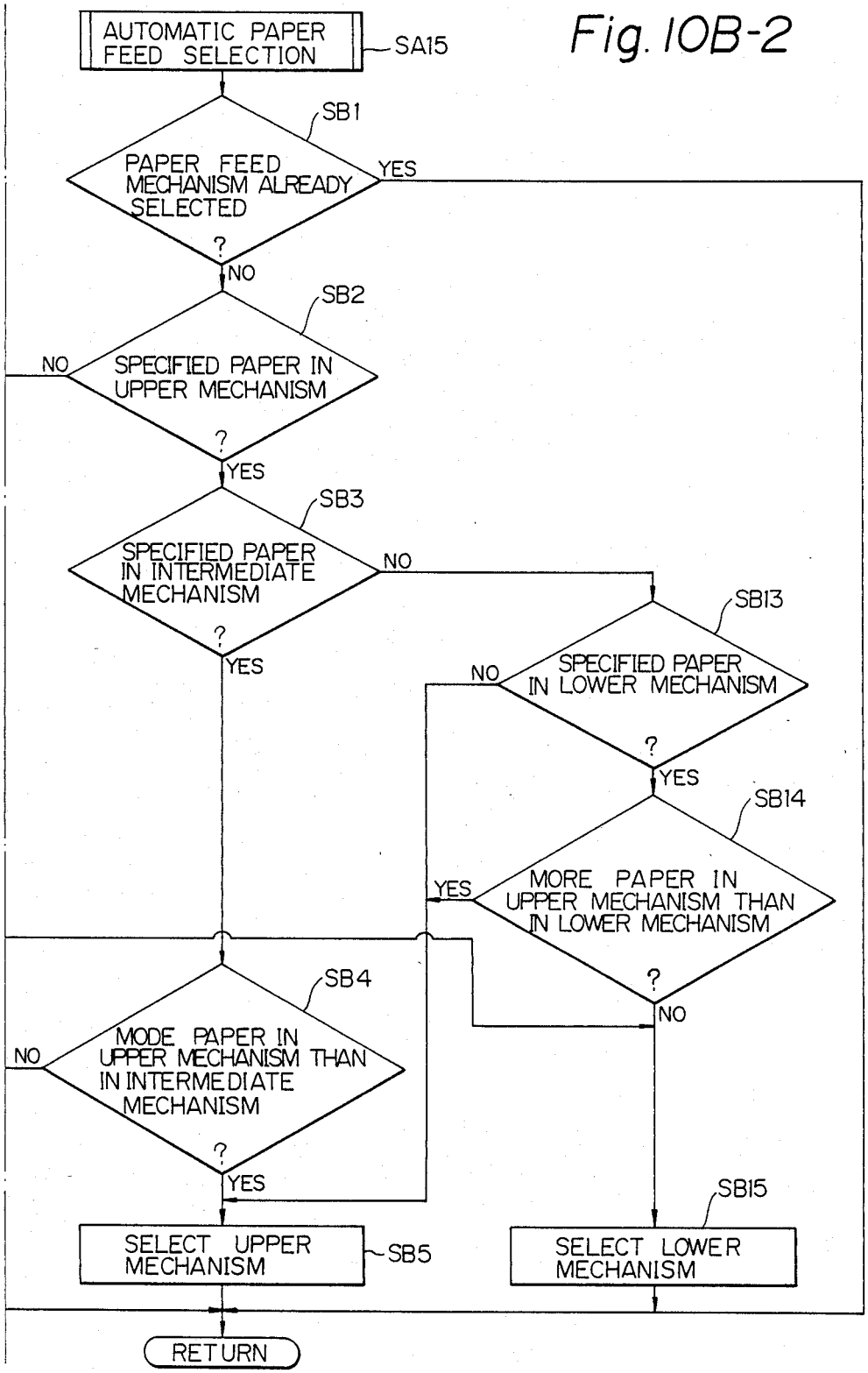

FIG. 10B shows the automatic paper feed selection subroutine of the step SA15 in detail. This subroutine begins with determining whether a particular paper feed mechanism has been selected (step SB1). In the initial condition, the program advances to the next step SB2 because no paper feed mechanism has been selected. In the step SB2, whether the upper paper feed mechanism 10 is loaded with a paper (recording medium) specified beforehand, i.e., whether the output of the sensor unit S31 (material sensor) and that of the sensor unit S41 (width sensor) which are associated with the mechanism 10 conform respectively to the size and the material specified by the keys K1 and K2 is determined. The step SB1 is followed by a step SB3 if such a paper is present in the mechanism 10 and by a step SB6 if otherwise. In the step SB3, whether the intermediate paper feed mechanism 20 is loaded with the specified paper is determined in the same manner. If the mechanism 20 is loaded with such a paper, the program advances to a step SB4 and, if otherwise, it advances to a step SB13.

In the step SB4, the amounts of paper remaining in the paper feed mechanisms 10 and 20 are compared by referencing the outputs of the sensor units S11 and S12. If the amount of remaining paper in the mechanism 10 is greater than that of remaining paper in the mechanism 20, a step SB5 is executed to select the mechanism 10. If otherwise, a step SB9 is executed to select the mechanism 20. In the step SB13, whether the lower paper feed mechanism 30 is loaded with the specified paper is determined as with the upper mechanism 10. If the mechanism 30 is loaded with such a paper, a step SB5 is executed to select the upper mechanism 10 and, if otherwise, a step SB14 is executed. In the step SB14, the amounts of paper remaining in the mechanisms 10 and 30 are compared by referencing the outputs of the sensor units S11 and S13. If the amount of remaining paper in the mechanism 10 is larger than that of remaining paper in the mechanism 30, the program advances to the step SB5 for selecting the mechanism 10. If otherwise, a step SB15 is executed to select the mechanism 30.

In the step SB6, whether the intermediate paper feed mechanism 20 is loaded with the specified paper is determined. If the mechanism 20 is loaded with such a paper, the program is transferred to a step SB7 and, if otherwise, to a step SB10. In the step SB7, whether the lower mechanism 30 is loaded with the specified paper is determined; a step SB8 is executed if the answer is YES and a step SB9 is executed if it is NO. In the step SB8, the amounts of paper remaining in the mechanisms 20 and 30 are compared by referencing the outputs of the sensor units S12 and S13. If the amount of remaining paper in the mechanism 20 is larger than that of remaining paper in the mechanism 30, the program is transferred to a step SB9 for selecting the mechanism 20; if otherwise, a step SB15 is executed to select the lower mechanism 30. In the step SB10, whether the mechanism 30 is loaded with the specified paper is determined; if the answer is YES, a step SB11 is executed for selecting the mechanism 30 and, if it is NO, a step SB12 is executed to set PAPER END ERROR. By such an automatic paper feed selection subroutine, unique operations for the selection of a paper feed mechanism are performed as follows.

When a specified paper exists in a plurality of paper feed mechanisms, e.g., upper and intermediate mechanisms 10 and 20, the steps SB1, SB2, SB3 and SB4 are sequentially executed and, then, the step SB5 or SB9 is executed to select one of the mechanisms 10 and 20 which has a larger amount of paper therein. Likewise, when both of the upper and lower paper feed mechanisms 10 and 30 are loaded with a specified paper, the steps SB1, SB2, SB3, SB13 and SB14 are sequentially performed and, then, the step SB5 or SB15 is executed to select one of the mechanisms 10 and 30 which has a larger amount of paper therein. Further, when both of the intermediate and lower mechanisms 20 and 30 are loaded with a specified paper, the steps SB1, SB2, SB6, SB7 and SB8 are sequentially executed and, then, the step SB9 or SB15 is executed to select one of the mechanisms 20 and 30 which has a larger amount of paper therein. Once any of the upper, intermediate and lower mechanisms 10, 20 and 30 is selected, it is inhibited from being replaced with another when this subroutine is executed afterwards, i.e., when the second copy and onward are sequentially produced, because the result of decision in the step SB1 will be YES.

Figure 10C:
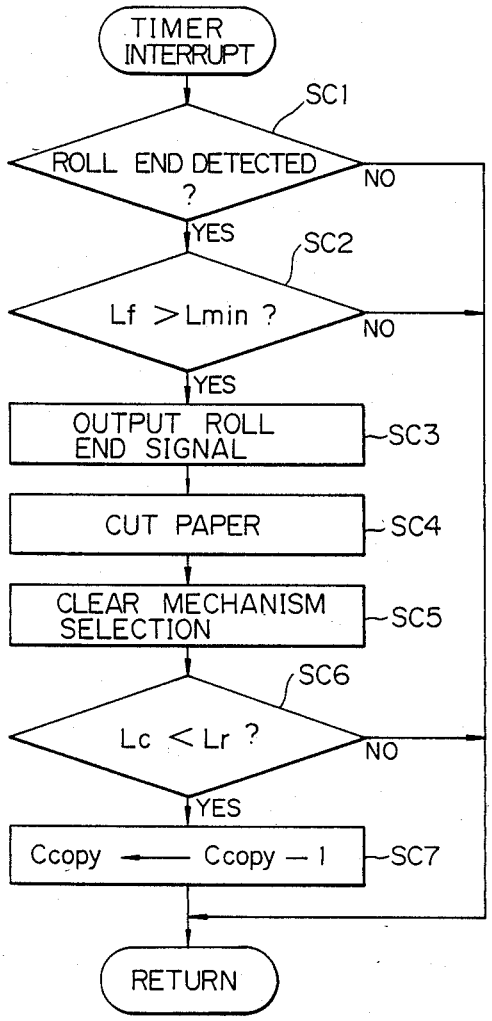

FIG. 10C shows the timer interrupt processing performed by the main control unit 80. This processing occurs repetitively in response to an interrupt request which a predetermined timer produces at a predetermined period. Specifically, in a step SC1, the main control unit 80 determines whether the roll in use has run out by referencing the outputs of the sensor unit S21, S22 or S23 associated with a particular paper feed mechanism being selected. In a step SC2, a length Lf of the paper paid out from the roll (after the previous cutting) is compared with a minimum length Lmin which can be transported by the transport system. In a step SC3, a roll end signal is outputted to display the roll end condition. In a step SC4, the cutter assembly associated with the paper feed mechanism being selected is driven to cut the paper. In a step SC5, a flag for storing the end of selection of the paper feed mechanism is cleared. In a step SC6, the length Lc of a cut sheet produced by the step SC4 is compared with the length Lr of a recording sheet to be used this time. Further, in a step SC7, the copy counter Ccopy is decremented.

The timer interrupt processing stated above occurs when a roll runs out. Specifically, when a paper feed mechanism being selected is exhausted, the step SC2 is executed to wait until the length LF of the paper paid out from the roll exceeds the minimum allowable length Lmin. As the length Lf exceeds the length Lmin, a roll end signal is produced to cut the last sheet in the mechanism being selected and, then, the selection of this mechanism is cleared. When the length Lc of the last sheet produced is shorter than the length Lr of a recording sheet to be used this time, the step SC7 is exeucted to decrement the copy counter Ccopy. In the step SC5, the flag is cleared. Hence, when the mechanism being selected runs out of the roll, the next automatic sheet feed selection subroutine (see FIG. 10B) proceeds from the step SB1 to the step SB2 for performing the select processing again. Assume that a specified paper is present in both of the upper and lower mechanisms 10 and 30 by way of example, and that the upper mechanism 10 is selected. Then, as the mechanism 10 runs out of the roll during the course of continuous copying, the steps SB1, SB2, SB6, SB10 and SB11 are sequentially performed to replace the upper mechanism 10 with the lower mechanism 30. As a result, a paper is fed from the lower mechanism 30 without the copying operation being interrupted.

It may occur that the last cut sheet produced after the roll has run out is short of the length of a recording sheet to be used then. Such a cut sheet would result in a defective copy and therefore prevent the operator from obtaining a desired number of complete copies. In the illustrative embodiment, when the roll runs out, the length Lc of the last cut sheet is compared with the length Lr of a specified sheet and, if the former is short of the latter, the step SC7 of the timer interrupt processing is executed to decrement the copy counter copy. In effect, therefore, the copying cycle is repeated by the number of times which is produced by adding one to the number of copies entered on the ten keys (value of Nset). This allows the operator to achieve a desired number of complete copies plus one copy which is defective.

When none of the paper feed mechanisms 10, 20 and 30 is loaded with a specified paper, the program is advanced to the step SB12 of FIG. 10B for setting PAPER END ERROR and, hence, the copying operation is inhibited.

It is to be noted that the present invention is applicable not only to an apparatus which uses the combination of a paper roll and a cutter assembly as shown and described but also to an apparatus of the type using an ordinary paper feed mechanism which feeds a stack of regular cut sheets one by one from a cassette.

In summary, it will be seen that the present invention provides a recording medium feeding device which frees a person from troublesome manipulations otherwise needed for the replacement and supply of a recording medium which is accommodated in a particular sheet feed mechanism in use.

Various modifications will become possible for those skilled in the art after receiving the teachings of the present disclosure without departing from the scope thereof.

What is claimed is:

1. A device installed in an image recording apparatus for feeding a recording medium, comprising:

a plurality of recording medium feeding means each comprising kind sensing means responsive to a kind of a recording medium, remaining amount sensing means responsive to a remaining amount of said recording medium, pulling means for pulling a leading edge of said recording medium onto a predetermined transport path, and driving means for driving said pulling means; and control means for controlling said recording medium feeding means such that any of said recording medium feeding means which is loaded with a recording medium of a kind specified beforehand is identified on the basis of outputs of said kind sensing means and, when a plurality of said recording medium feeding means are each loaded with said recording medium of said specified kind, one of said recording medium feeding means which has the largest amount of recording medium remaining therein is selected as recording medium feeding means for feeding a recording medium on the basis of outputs of said remaining amount sensing means which are individually associated with said plurality of recording medium feeding means.

2. A device as claimed in claim 1, wherein said control means further controls said recording medium feeding means such that, if the recording medium of the specified kind is present in any of the other recording medium feeding means when the amount of recording medium remaining in said one recording medium feeding means being selected becomes substantially zero, said one recording medium feeding means is automatically replaced with any of said other recording medium feeding means which is also loaded with the recording medium of the specified kind.

3. A device as claimed in claim 1, wherein said recording medium comprises an elongate webbing in the form of a roll, said recording medium feeding means further comprising at least one cutting means for cutting said recording medium along an axis which is substantially perpendicular to an intended direction of recording medium feed, said control means, when the amount of recording medium remaining in said one recording medium feeding means being selected becomes substantially zero, feeding one extra recording medium in addition to a number of recording media which is specified beforehand.

4. A device as claimed in claim 1, wherein the recording medium comprises a stack of cut sheets.

* * * * *